US006497801B1

(12) United States Patent
Woodruff et al.

(10) Patent No.: US 6,497,801 B1
(45) Date of Patent: Dec. 24, 2002

(54) ELECTROPLATING APPARATUS WITH SEGMENTED ANODE ARRAY

(76) Inventors: Daniel J. Woodruff, 409 Northridge Dr., Kalispell, MT (US) 59901; Kyle M. Hanson, 110 Greenbriar Dr., Kalispell, MT (US) 59901

( * ) Notice: Subject to any disclaimer, the term of this patent is extended or adjusted under 35 U.S.C. 154(b) by 0 days.

(21) Appl. No.: 09/113,418

(22) Filed: Jul. 10, 1998

(51) Int. Cl.[7] ..... C25D 5/50; C25D 3/12

(52) U.S. Cl. ..... 204/230.2; 204/224 R; 204/269; 204/272; 204/275

(58) Field of Search ..... 204/272, 242, 204/224 R, 271, 230.2, 269, 275

(56) References Cited

U.S. PATENT DOCUMENTS 3,706,651 A * 12/1972 Leland ..... 204/218
4,082,638 A * 4/1978 Jumer ..... 204/224 M X
4,604,177 A * 8/1986 Sivilotti ..... 204/244
4,604,178 A * 8/1986 Fleegener et al. ..... 204/286
4,828,654 A * 5/1989 Reed ..... 204/23
5,146,136 A * 9/1992 Ogura et al. ..... 315/39
5,156,730 A * 10/1992 Bhatt et al. ..... 205/118
5,217,586 A * 6/1993 Datta et al. ..... 204/224 M X
5,316,642 A * 5/1994 Young, Jr. et al. ..... 204/198

* cited by examiner

*Primary Examiner*—Donald R. Valentine
(74) *Attorney, Agent, or Firm*—Polit & Associates, LLC; Harry M. Cross

(57) ABSTRACT

An electroplating apparatus includes a reactor vessel having a segmented anode array positioned therein for effecting electroplating of an associated workpiece such as a semiconductor wafer. The anode array includes a plurality of ring-like anode segments which are preferably positioned in concentric, coplanar relationship with each other. The anode segments can be independently operated to create varying electrical potentials with the associated workpiece to promote uniform deposition of electroplated metal on the surface of the workpiece.

14 Claims, 7 Drawing Sheets

ELECTROPLATING APPARATUS WITH SEGMENTED ANODE ARRAY

CROSS-REFERENCE TO RELATED APPLICATIONS

Not Applicable.

Statement Regarding Federally Sponsored Research or Development

Not applicable.

BACKGROUND OF THE INVENTION

The present invention relates generally to an electroplating apparatus for plating of semiconductor components, and more particularly to an electroplating apparatus, including a segmented anode array comprising a plurality of concentrically arranged anode segments which can be independently operated to facilitate uniform deposition of electroplated metal on an associated workpiece.

Production of semiconductive integrated circuits and other semiconductive devices from semiconductor wafers typically requires formation of multiple metal layers on the wafer to electrically interconnect the various devices of the integrated circuit. Electroplated metals typically include copper, nickel, gold and lead. Electroplating is effected by initial formation of a so-called seed layer on the wafer in the form of a very thin layer of metal, whereby the surface of the wafer is rendered electrically conductive. This electroconductivity permits subsequent formation of a so-called blanket layer of the desired metal by electroplating in a reactor vessel. Subsequent processing, such as chemical, mechanical planarization, removes unwanted portions of the metal blanket layer formed during electroplating, resulting in the desired patterned metal layer in a semiconductor integrated circuit or micro-mechanism being formed. Formation of a patterned metal layer can also be effected by electroplating.

Subsequent to electroplating, the typical semiconductor wafer or other workpiece is subdivided into a number of individual semiconductor components. In order to achieve the desired formation of circuitry within each component, while achieving the desired uniformity of plating from one component to the next, it is desirable to form each metal layer to a thickness which is as uniform as possible across the surface of the workpiece. However, because each workpiece is typically joined at the peripheral portion thereof in the circuit of the electroplating apparatus (with the workpiece typically functioning as the cathode), variations in current density across the surface of the workpiece are inevitable. In the past, efforts to promote uniformity of metal deposition have included flow-controlling devices, such as diffusers and the like, positioned within the electroplating reactor vessel in order to direct and control the flow of electroplating solution against the workpiece.

In a typical electroplating apparatus, an anode of the apparatus (either consumable or non-consumable) is immersed in the electroplating solution within the reactor vessel of the apparatus for creating the desired electrical potential at the surface of the workpiece for effecting metal deposition. Previously employed anodes have typically been generally disk-like in configuration, with electroplating solution directed about the periphery of the anode, and through a perforate diffuser plate positioned generally above, and in spaced relationship to, the anode. The electroplating solution flows through the diffuser plate, and against the associated workpiece held in position above the diffuser. Uniformity of metal deposition is promoted by rotatably driving the workpiece as metal is deposited on its surface.

The present invention is directed to an electroplating apparatus having a segmented anode array, including a plurality of anode segments which can be independently operated at different electrical potentials to promote uniformity of deposition of electroplated metal on a associated workpiece.

BRIEF SUMMARY OF THE INVENTION

An electroplating apparatus embodying the principles of the present invention includes an electroplating reactor vessel which contains a segmented anode array immersed in electroplating solution held by the vessel. The anode array includes differently dimensioned anode segments, preferably comprising concentrically arranged ring-like elements, with the anode segments being independently operable at different electrical potentials. The flow of electroplating solution about the anode segments is controlled in conjunction with independent operation of the segments, with uniformity of electroplated metal deposition on the workpiece thus promoted.

In accordance with the illustrated embodiments, the present electroplating apparatus includes an electroplating reactor including a cup-like reactor vessel for holding electroplating solution. A segmented anode array in accordance with the present invention is positioned in the reactor vessel for immersion in the plating solution. The electroplating apparatus includes an associated rotor assembly which can be positioned generally on top of the electroplating reactor, with the rotor assembly configured to receive and retain an associated workpiece such as a semiconductor wafer. The rotor assembly is operable to position the workpiece in generally confronting relationship with the anode array, with the surface of the workpiece in contact with the electroplating solution for effecting deposition of metal on the workpiece. The reactor vessel defines an axis, with the workpiece being positionable in generally transverse relationship to the axis.

The anode array comprises a plurality of anode segments having differing dimensions, with the array being operable to facilitate uniform deposition of electroplated metal on the workpiece. In accordance with the illustrated embodiment, the segmented anode array is positioned generally at the lower extent of the reactor vessel in generally perpendicular relationship to the axis defined by the vessel. The anode array comprises a plurality of ring-like, circular anode segments arranged in concentric relationship to each other about the axis. Thus, at least one of the anode segments having a relatively greater dimension is positioned further from the axis than another one of the anode segments having a relatively lesser dimension. In the illustrated embodiment, each of the anode segments is configured to have an annular, ring-shape, with each being generally toroidal. It is presently preferred that the anode segments be generally coplanar, although it will be appreciated that the segments can be otherwise arranged.

The anode array includes a mounting base upon which the ring-like anode segments are mounted. The present invention contemplates various arrangements for directing and controlling flow of the associated electroplating solution. In particular, the mounting base can define at least one flow passage for directing flow of electroplating solution through the mounting base. In one form, a central-most one of the anode segments defines an opening aligned with the reactor vessel axis, with the flow passage defined by the mounting base being aligned with the opening in the central anode segment. In another embodiment, flow passages defined by the mounting base are positioned generally between adjacent ones of the anode segments for directing flow of electroplating solution therebetween. In this embodiment, a plurality of flow passages are provided which are arranged in a pattern of concentric circles to direct flow of electroplating solution between adjacent ones of the concentrically arranged anode segments.

In an alternate embodiment, the mounting base includes a plurality of depending, flow-modulating projections, defining flow channels therebetween, with the projections arranged generally about the periphery of the mounting base. In the preferred form, the present electroplating apparatus includes a control arrangement operatively connected to the segmented anode array for independently operating the plurality of anode segments. This permits the segments to be operated at different electrical potentials, and for differing periods of time, to facilitate uniform deposition of electroplated metal on the associated workpiece. The present invention contemplates that dielectric elements can also be positioned between at least two adjacent ones of the anode segments for further facilitating uniform deposition of electroplated metal on the workpiece.

Other features and advantages of the present invention will become readily apparent from the following detailed description, the accompanying drawings, and the appended claims.

DETAILED DESCRIPTION OF THE INVENTION

Figure 1:
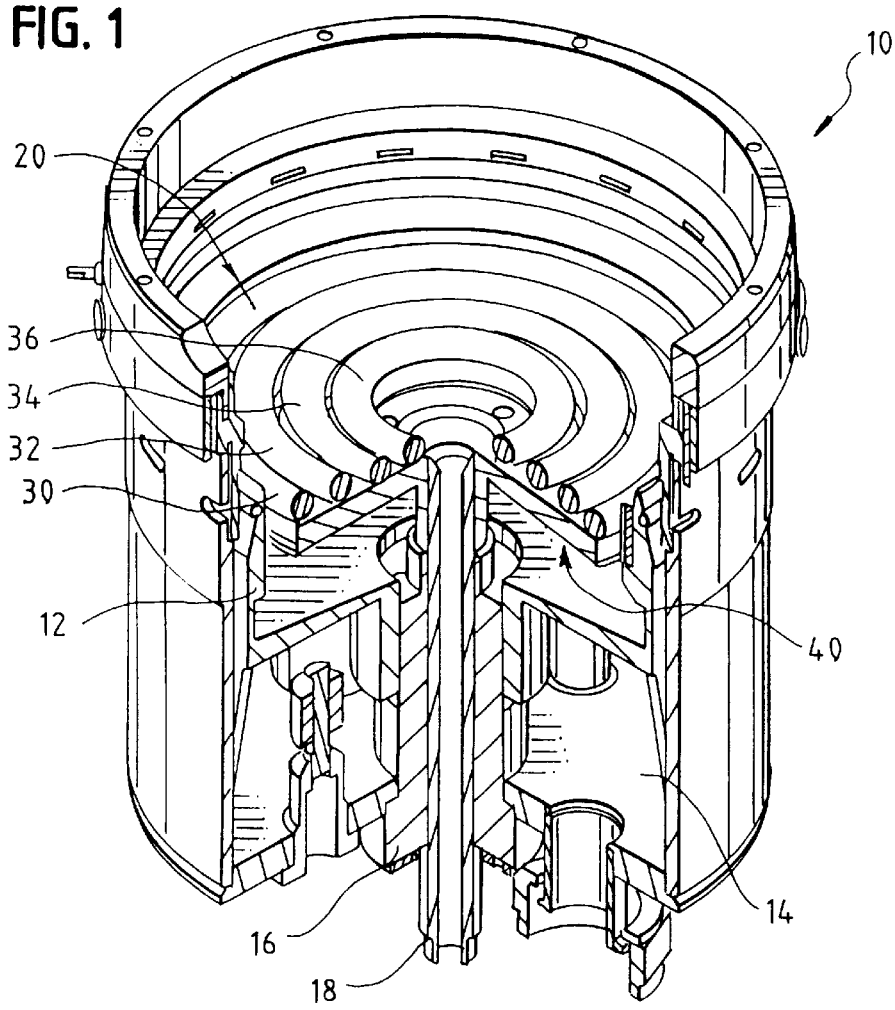
FIG. 1 is a perspective view, in partial cross-section, of an electroplating reactor of an electroplating apparatus, including a segmented anode array, embodying the principles of the present invention.

While the present invention is susceptible of embodiment in various forms, there is shown in the drawings and will hereinafter be described presently preferred embodiments, with the understanding that the present disclosure is to be considered as an exemplification of the invention, and is not intended to limit the invention to the specific embodiments illustrated.

With reference first to FIG. 1, therein is illustrated an electroplating reactor 10 of an electroplating apparatus embodying the present invention. This type of electroplating apparatus is particularly suited for electroplating of semiconductor wafers or like workpieces, whereby an electrically conductive seed layer of the wafer is electroplated with a metallic blanket or patterned layer.

Figure 14:
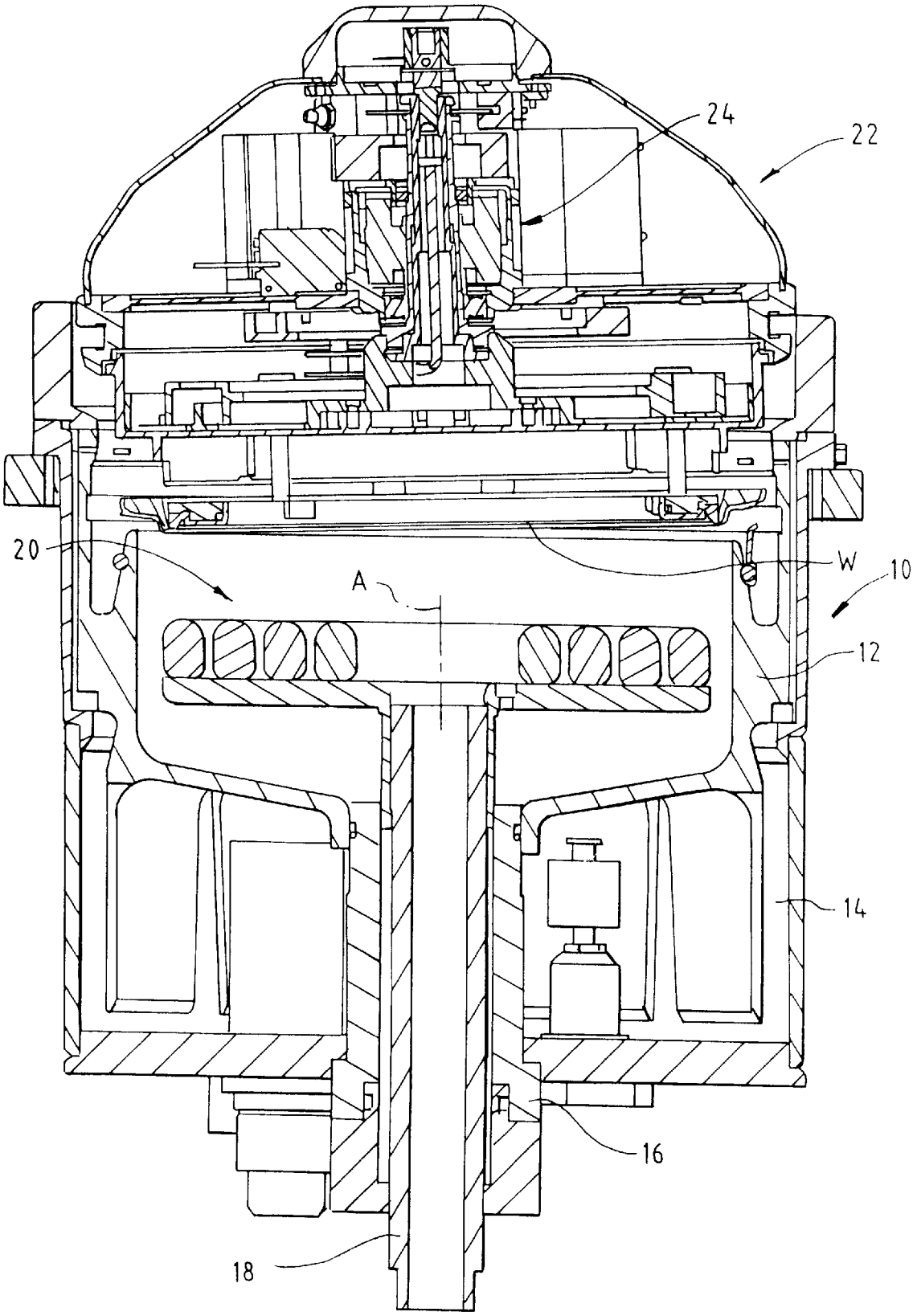
FIG. 14 is a diagrammatic view of the present electroplating apparatus, with a rotor assembly and associated reactor positioned together for workpiece processing.

The electroplating reactor 10 is that portion of the apparatus which generally contains electroplating solution, and which directs the solution against a generally downwardly facing surface of an associated workpiece, W, to be plated (see FIG. 14). To this end, the reactor 10 includes a reactor vessel or cup 12 through which electroplating solution is circulated. Attendant to solution circulation, the solution flows from the reactor vessel 12, over the weir-like periphery of the vessel, into a lower overflow chamber 14 of the reactor 10. Solution is drawn from the overflow chamber typically to be replenished for re-circulation through the reactor.

Reactor 10 includes a riser tube 16, within which an inlet conduit 18 is positioned for introduction of electroplating solution into the reactor vessel. A segmented anode array 20, embodying the principles of the present invention, is positioned generally at the upper extent of the inlet conduit 18 in a manner, as will be further described, which promotes flow of electroplating solution over and about the anode array 20. During processing, a rotor assembly 22 (FIG. 14) which receives and holds a workpiece W for electroplating, is positioned in cooperative association with reactor 10 such that the workpiece W is positioned in generally confronting relationship to the anode array 20. As will be observed, the reactor vessel 12 defines an axis "A" (FIG. 14), with the workpiece W positioned in generally transverse relationship to the axis. Similarly, the anode array 20 is positioned in generally transverse relationship to the axis "A", preferably perpendicular thereto. While the workpiece W may be positioned perpendicularly to the axis "A", the illustrated arrangement positions the workpiece W at an acute angle (such as on the order of 2°) relative to the surface of the electroplating solution within the reactor vessel 12 to facilitate venting of gas which can accumulate at the surface of the workpiece. During processing, the workpiece is rotatably driven by drive motor 24 of the rotor assembly for facilitating uniformity of deposition of electroplated metal on the workpiece surface.

With particular reference to FIGS. 2–5, the segmented anode array 20 includes a plurality of anode segments having differing dimensions, with at least one of the anode segments having a relatively greater dimension being positioned further from the axis of the reactor vessel than another one of the anode segments having a relatively lesser dimension. In particular, the anode segments comprise circular, ring-like elements, each of which is generally toroidal, and arranged in concentric relationship with each other. As is known in the art, the anode segments may be consumable, whereby metal ions of the anode segments are transported by the electroplating solution to the electrically conductive surface of the associated workpiece, which functions as a cathode.

In this illustrated embodiment, the segmented anode array 20 includes four (4) anode segments, respectively designated 30, 32, 34 and 36. The anode segments are of relatively decreasing diameters, with the segments thus fitting one-within-the-other.

It is preferred that the anode segments be positioned in generally coplanar relationship with each other, with the segments coaxial with each other along axis "A". In order to maintain the segments in this relative disposition, the anode array 20 includes a mounting base 40 upon which each of the anode segments is mounted. The mounting base 40 includes a collar portion 42 which defines a flow passage for directing flow of electroplating solution through the mounting base. In this embodiment, the central-most one of the concentric anode segments defines an opening aligned with the axis "A" of the reactor vessel, with the flow passage defined by the collar portion of the mounting base 40 being aligned with the opening defined by this central-most one 36 of the anode segments.

Figure 1A:
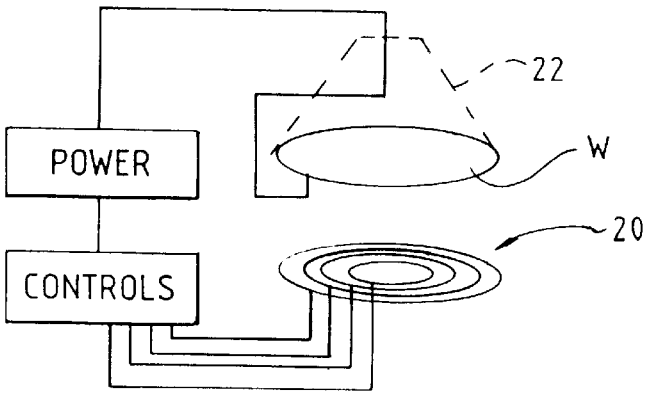
FIG. 1*a* is a diagrammatic view of a control system for the present electroplating apparatus.
Figure 2:
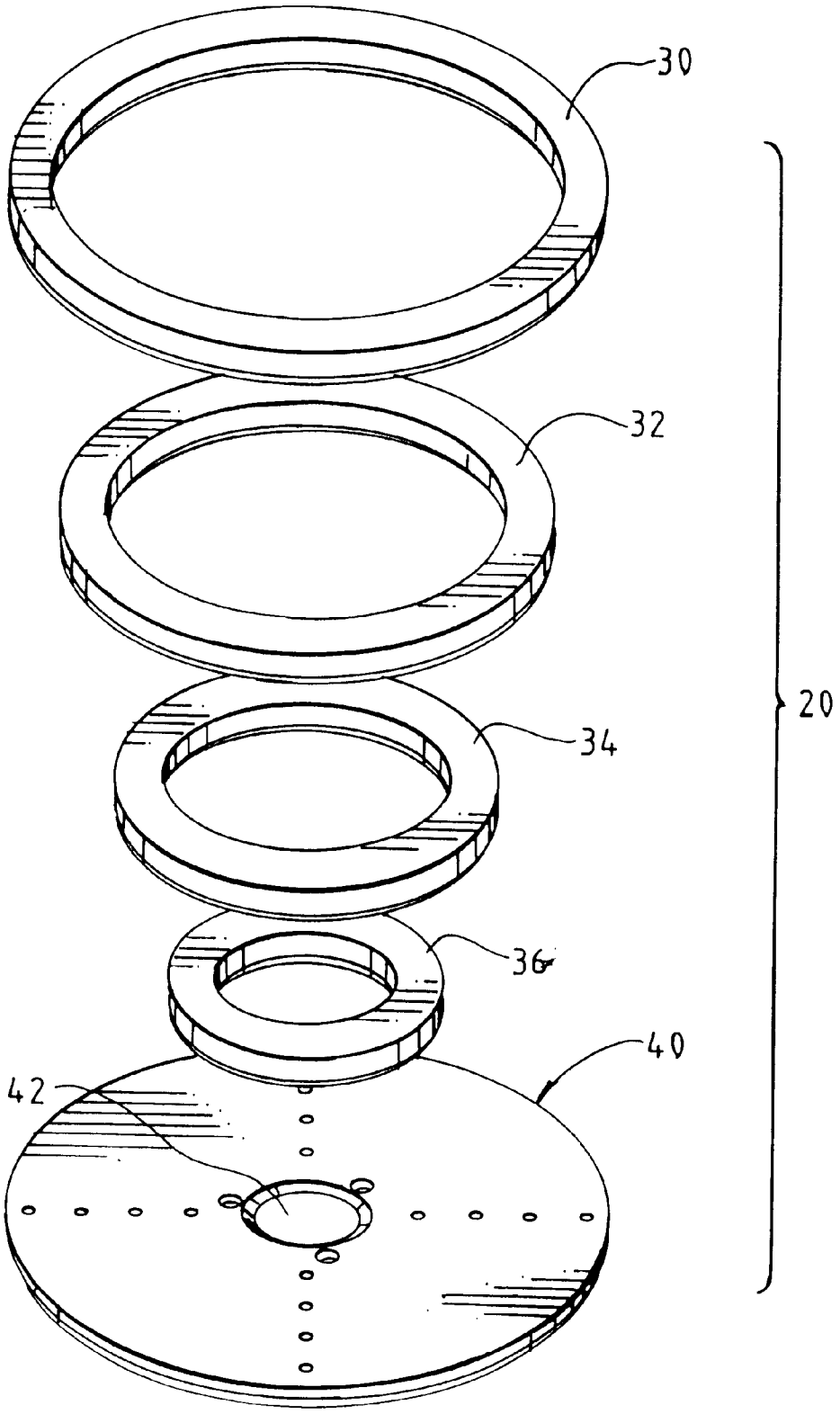
FIG. 2 is an exploded perspective view of the segmented anode array illustrated in FIG. 1.
Figure 3:
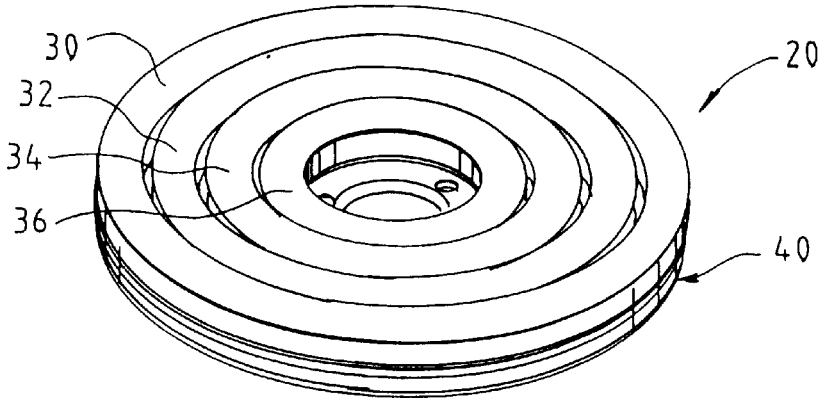
FIG. 3 is a top perspective view of the assembled anode array of FIG. 2.
Figure 4:
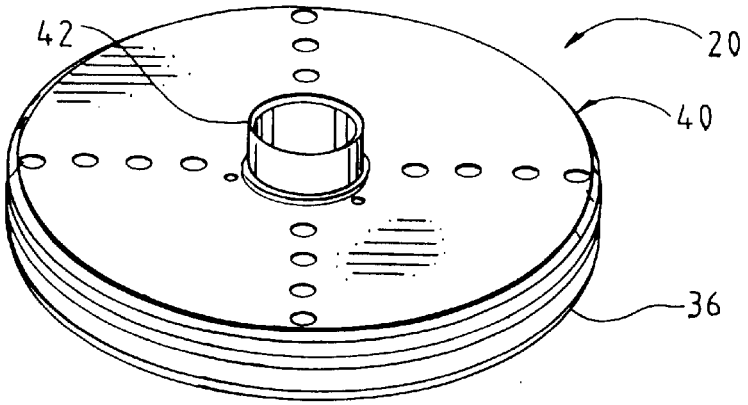
FIG. 4 is a bottom perspective view of the anode array illustrated in FIG. 3.
Figure 5:
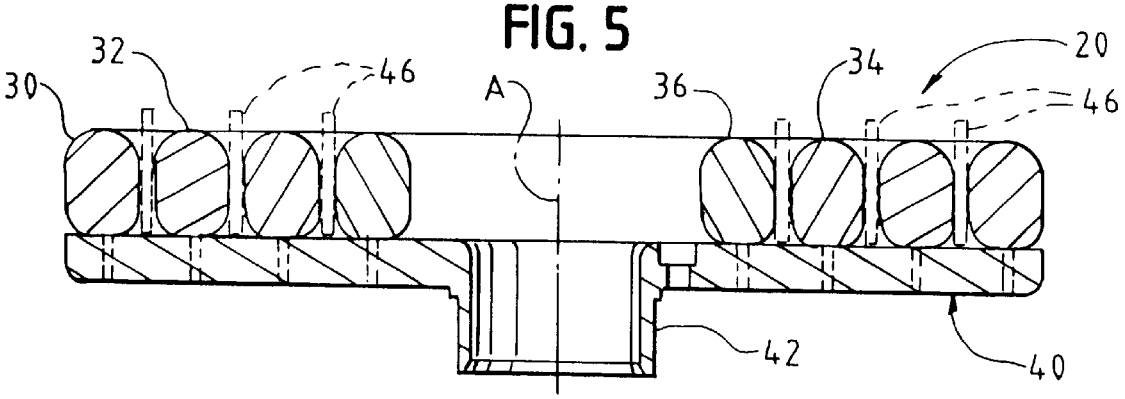
FIG. 5 is a cross-sectional view of the anode array illustrated in the preceding FIGURES.
Figure 6:
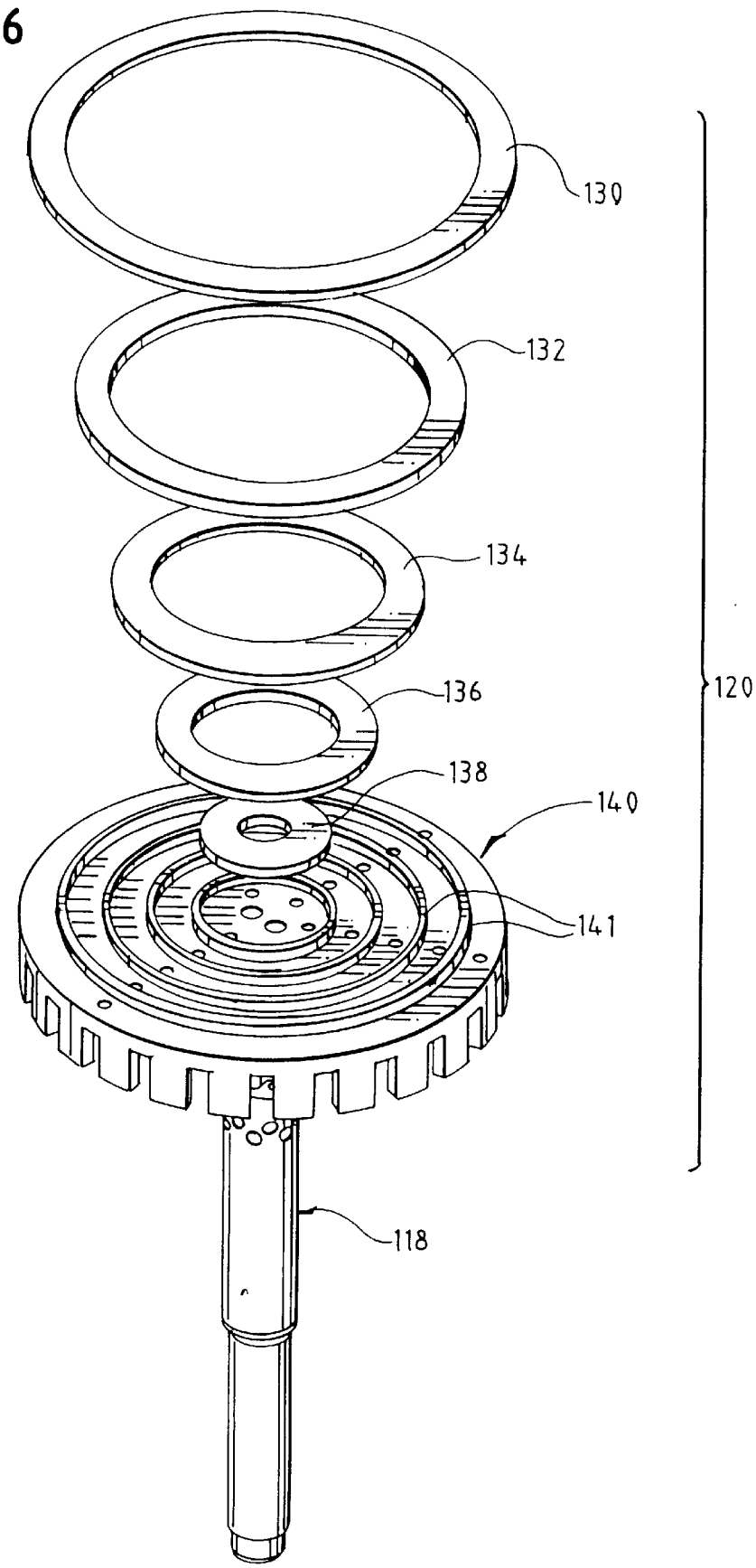
FIG. 6 is an exploded perspective view of an alternative embodiment of the present segmented anode array.
Figure 7:
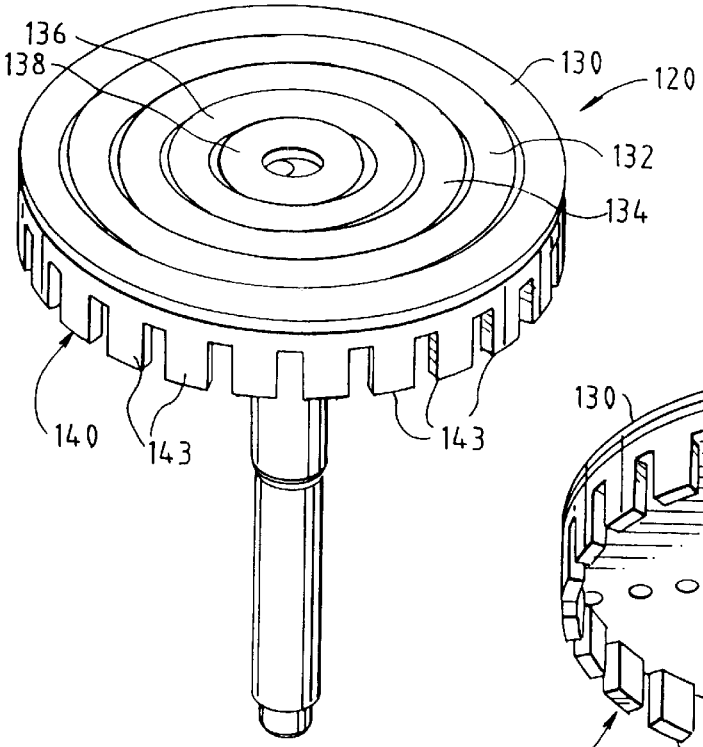
FIG. 7 is a top perspective view of the assembled segmented anode array illustrated in FIG. 6.

Operation of this embodiment of the present invention contemplates that plating solution is pumped through inlet conduit 18, through the flow passage defined by collar portion 42 of mounting base 40, and through the center of the anode array so that the solution impinges upon the surface of the workpiece W. The plating rate at the surface of the workpiece ordinarily will vary radially due to the effect of the impinging solution on the hydrodynamic boundary layer. Compensation of this radial effect can be achieved by operating the anode segments at different electrical potentials. Such an arrangement is diagrammatically illustrated in FIG. 1*a*, wherein controls of the present electroplating apparatus include suitable wiring for independently operating the plurality of segments of the anode array 20. It is contemplated that not only can the various anode segments be operating at differing electrical potentials, they may also be operated for differing periods of time to optimize the uniformity of plating on the workpiece.

In addition to affecting plating uniformity by using different anode potentials, it is within the purview of the present invention to affect uniformity by the disposition of dielectric (insulating) elements between adjacent ones of the anode segments. This is illustrated in phantom line in FIG. 5, wherein dielectric elements 46 are positioned between each adjacent pair of the anode segments 30, 32, 34 and 36.

The geometry of the dielectric elements can be modified to provide the desired effect on plating. Relatively tall geometries, i.e., dielectric elements which project significantly above the associated anode segments, are believed to tend to limit interaction of adjacent ones of the anode segments, and can tend to collimate solution flow to the workpiece. In contrast, shorter or perforated geometries are believed to tend to increase anode segment interaction. While the illustrated embodiments of the present invention show the anode segments positioned in coplanar relationship with each other, and thus, in generally equidistant relationship to the workpiece W, it is believed that an increase or decrease in anode segment interaction can also be achieved by positioning the ring-like anode segments at varying distances from the surface of the workpiece.

Depending upon the type of electroplating process, the segments of the anode array may be either consumable, or non-consumable. For those applications requiring a consumable anode, the anode segments can be formed from copper, such as phosphorized copper. In contrast, non-consumable anode segments can be formed from platinum plated titanium.

It is contemplated that suitable mechanical fasteners (not shown) be employed for individually securing each of the anode segments to the associated mounting base 40. Additionally, suitable sealed wiring (not shown) is provided for individually electrically connecting each of the anode segments with associated controls of the electroplating apparatus, whereby the electrical potential created by each anode segment can be independently varied and controlled. In this embodiment, it is contemplated that no perforate diffuser member be employed positioned between the anode array 20 and the workpiece W. Solution flow rate and current distribution can be controlled independently of one another to optimize the plating process and promote uniformity of deposition of electroplated metal. Air bubbles introduced into the plating chamber by the incoming plating solution are flushed past the workpiece surface, and thus will not interfere with the plating process. Venting of the workpiece surface, by its angular disposition as discussed above, may also be effected. Solution flow from the center of the anode array insures that the workpiece surface will be wetted from the center to the periphery. This prevents air from being trapped at the center of the workpiece when it first contacts the surface of the solution.

As will be appreciated, the use of a segmented anode array having circular anode segments is particularly suited for use with circular, disk-like wafers or like workpieces. However, it is within the purview of the present invention that the anode array, including the anode segments, be non-circular.

With reference now to FIGS. 6–9, therein is illustrated an alternate embodiment of the present segmented anode array. In this embodiment, elements which generally correspond to those in the above-described embodiment are designated by like reference numerals in the one-hundred series.

Segmented anode array 120 includes a plurality of ring-like anode segments. In this embodiment, five (5) of the anode segments are provided in concentric relationship with each other, including segments 130, 132, 134, 136 and 138.

The anode array 120 includes a mounting base 140 having a plurality of divider elements 141 respectively positioned between adjacent ones of the circular anode segments. As in the previous embodiment, the anode segments are positioned in coplanar relationship with each other on the mounting base, and are positioned in coaxial relationship with the axis "A" of the associated reactor vessel.

In distinction from the previous embodiment, anode array 120 is configured such that flow of electroplating solution is directed generally about the periphery of the array. In particular, the mounting base 140 includes a plurality of circumferentially spaced depending flow-modulating projections 143 which define flow channels between adjacent ones of the projections. Electroplating solution is introduced into the reactor vessel through an inlet conduit 118, which defines a plurality of flow passages 119 generally at the upper extent thereof, beneath mounting base 140, and inwardly of flow-modulating projections 143. The solution then flows between the flow-modulating projections, and upwardly generally about the anode segments.

Figure 8:
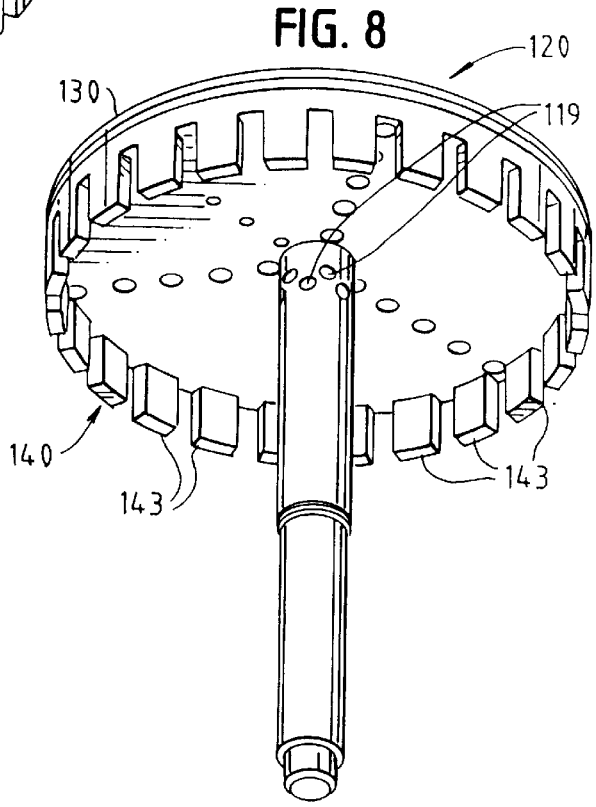
FIG. 8 is a bottom perspective view of the anode array illustrated in FIG. 7.
Figure 9:
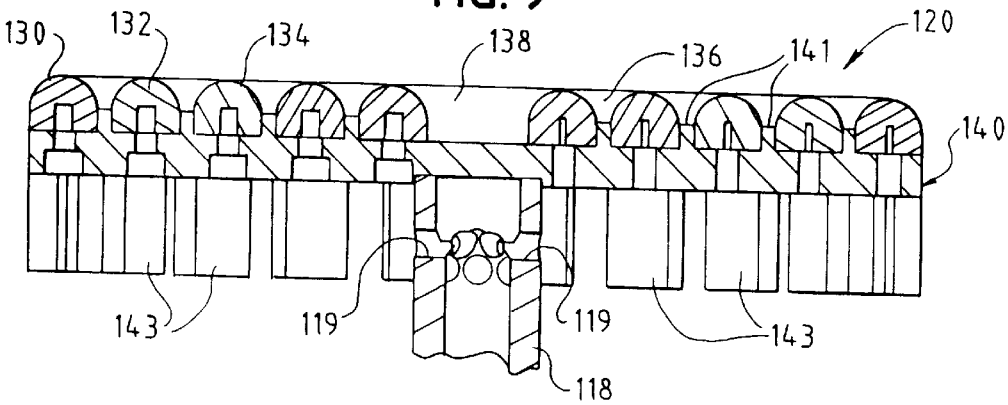
FIG. 9 is a cross-sectional view of the segmented anode array illustrated in FIGS. 6–8.
Figure 10:
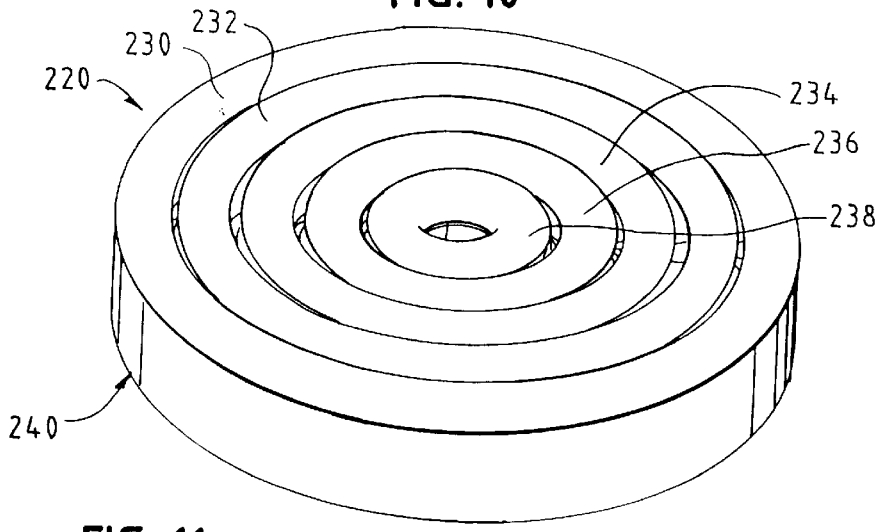
FIG. 10 is a top perspective view of a further alternative embodiment of the present segmented anode array.
Figure 11:
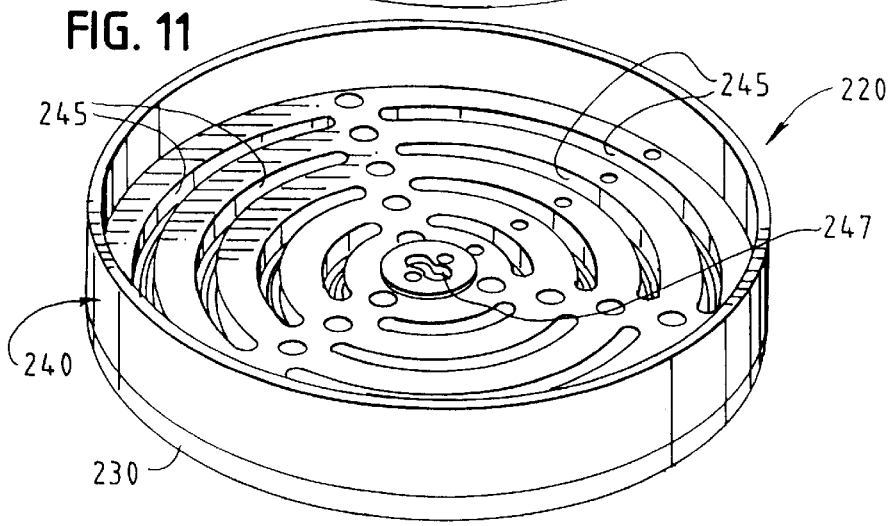
FIG. 11 is a bottom perspective view of the segmented anode array shown in FIG. 10.
Figure 12:
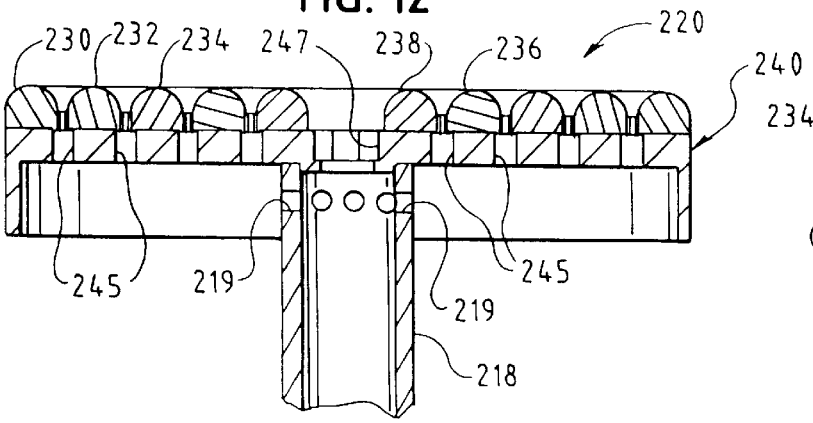
FIG. 12 is a cross-sectional view of the segmented anode array shown in FIGS. 11 and 12.
Figure 13:
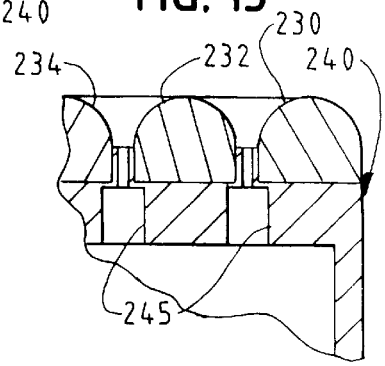
FIG. 13 is a relatively enlarged, fragmentary cross-sectional view of the segmented anode array shown in FIG. 12.

This embodiment illustrates a series of openings defined by mounting base 140. With particular reference to FIG. 8, those series of holes aligned at 120° intervals about the base portion are configured for receiving respective mechanical fasteners (not shown) for securing the anode segments to the mounting base. The remaining series of radially-spaced openings defined by the mounting base are provided for suitable electrical connection with each individual anode segment.

With reference to FIGS. 10–13, another alternate embodiment of the segmented anode array embodying the principles of the present invention is illustrated. Elements of this embodiment, which generally correspond to like elements in the previously described embodiment, are so-designated by like reference numerals in the two-hundred series.

Anode array 220 includes a plurality of circular, concentrically arranged ring-like anode segments 230, 232, 234, 236 and 238. The anode segments are positioned in coplanar relationship on a mounting base 240. Notably, this configuration of the anode array is arranged to permit flow of electroplating solution between adjacent ones of the anode segments. To this end, the mounting base 240 defines a plurality of flow passages 245 arranged in a pattern of concentric circles to direct flow of electroplating solution between adjacent ones of the ring-like anode segments. An inlet conduit 218 defines a plurality of flow passages 219 so that plating solution can flow from the inlet conduit through the flow passages 245. This embodiment also includes a flow passage 247 defined by the mounting base 240 for directing flow through an opening defined by the central-most one 238 of the anode segments.

From the foregoing, it will be observed that numerous modifications and variations can be effected without departing from the true spirit and scope of the novel concept of the present invention. It will be understood that no limitation with respect to the specific embodiments illustrated herein is intended or should be inferred. The disclosure is intended to cover, by the appended claims, all such modifications as fall within the scope of the claims.

What is claimed is:

1. An electroplating apparatus for electroplating a workpiece, comprising:

an electroplating reactor including a reactor vessel for holding electroplating solution, said reactor vessel defining an axis, the workpiece being disposed in a generally co-axial arrangement with the axis during electroplating of the workpiece;

an anode array positioned within said reactor vessel and spaced from the workpiece in generally coaxial relationship to said axis, said anode array comprising a plurality of anode segments arranged in concentric relationship to each other about said axis, the anode segments being connected to a source of electrical power so that individual anode segments can be electrically energized independent of other anode segments; and a mounting base upon which said anode segments are mounted;

one or more dielectric projections in fixed relation with the mounting base and proceeding between at least one pair of adjacent anode segments, the dielectric projections dimensioned to extend axially beyond the at least one pair of adjacent anode segments for facilitating electrical isolation of the pair of adjacent anode segments.

2. An electroplating apparatus in accordance with claim 1, wherein said plurality of anode segments are generally ring-shaped and concentrically arranged with one another in a coplanar manner.

3. An electroplating apparatus in accordance with claim 1, wherein each of said anode segments comprises a generally convex conductive surface disposed to face the work piece.

4. An electroplating apparatus in accordance with claim 1, wherein said segmented anode array includes a mounting base upon which said anode segments are mounted, said mounting base defining at least one flow passage for directing flow of the electroplating solution therethrough between at least one pair of adjacent anode segments.

5. An electroplating apparatus in accordance with claim 4, wherein a central-most one of said anode segments defines an opening aligned with said axis, said mounting base further comprising a further flow passage aligned with said opening defined by said central-most anode segment to thereby provide a central flow path for the electroplating solution.

6. An electroplating apparatus in accordance with claim 4 wherein a plurality of said flow passages are arranged in a pattern of concentric circles to direct flow of electroplating solution between adjacent ones of said anode segments.

7. An electroplating apparatus in accordance with claim 4, wherein said mounting base includes a plurality of depending, flow-modulating projections defining flow channels therebetween.

8. An electroplating apparatus in accordance with claim 1, including control means operatively connected to said segmented anode array for independently operating said plurality of anode segments.

9. An apparatus for electroplating a metal on a workpiece with a highly uniform deposition, comprising:

a reactor vessel for holding an electroplating solution;

a fluid inlet in fluid communication with said reactor vessel for supplying a flow of said electroplating solution during the plating process;

a workpiece holder, cooperating with said reactor vessel, including one or more surfaces disposed to support the workpiece in contact with said electroplating solution during the electroplating process, the workpiece holder further including an electrically conductive path connecting the workpiece to cathodic potential;

an anode array positioned in said reactor vessel in generally confronting relationship with the workpiece and adapted for immersion in said electroplating solution, said anode array comprising a plurality of ring-shaped anode segments having differing radial dimensions that are arranged concentric with one another; and a mounting base upon which said ring-shaped anode segments are mounted, said mounting base having a plurality of flow passages in communication with said fluid inlet for providing a diffuse flow of said electroplating solution in said reactor vessel that is generally directed toward the workpiece.

10. An electroplating apparatus in accordance with claim 9 wherein at least one of the plurality of flow passages is disposed between an adjacent pair of ring-shaped anode segments.

11. An electroplating apparatus in accordance with claim 9 wherein the ring-shaped anode segments comprise a convex conductive surface disposed to face a surface of the workpiece that is to be electroplated.

12. An apparatus for processing a disc-shaped workpiece, comprising:

an electroplating reactor including a reactor vessel for holding an electrolyte solution; and an anode array disposed in said reactor vessel at a position for immersion in the electrolyte solution, said anode array comprising a plurality of generally ring-shaped, concentric anode segments having differing radial dimensions, said generally ring-shaped, concentric anode array being arranged so that it is co-axial with respect to the disc-shaped workpiece to thereby facilitate uniform deposition of electroplated metal on said disc-shaped workpiece, and a mounting base upon which said anode segments are mounted, said mounting base defining at least one flow passage for directing flow of the electroplating solution between at least one pair of radially adjacent anode segments.

13. An apparatus for processing a workpiece, comprising:

an electroplating reactor including a reactor vessel for holding an electrolyte;

an anode array disposed in said reactor vessel at a position for immersion in the electrolyte solution, said anode array comprising a plurality of concentric anode segments having differing radial dimensions, said concentric anode array being arranged so that it is co-axial with respect to the workpiece to thereby facilitate uniform deposition of electroplated metal on said workpiece, and a mounting base upon which said anode segments are mounted, and dielectric projections in fixed relation with the mounting base and proceeding between at least one pair of adjacent anode segments, the dielectric projections dimensioned to extend axially beyond the at least one pair of adjacent anode segments for facilitating uniform deposition of electroplated metal on the workpiece.

14. An apparatus as claimed in claim 13 wherein the workpiece is generally disc-shaped and wherein the plurality of concentric anode segments are generally ring-shaped.

* * * * *

UNITED STATES PATENT AND TRADEMARK OFFICE

CERTIFICATE OF CORRECTION

PATENT NO. : 6,497,801 B1 
DATED : December 24, 2002
INVENTOR(S) : Woodruff et al.

It is certified that error appears in the above-identified patent and that said Letters Patent is hereby corrected as shown below:

Column 8,
Line 3, "work piece" should be -- workpiece --;

Signed and Sealed this

Twenty-sixth Day of August, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,497,801 B1 
DATED : December 24, 2002
INVENTOR(S) : Woodruff et al.

It is certified that error appears in the above-identified patent and that said Letters Patent is hereby corrected as shown below:

Title page,
Item [73], Assignee, should be -- Semitool, Inc., Kalispell, MT (US) --;

Signed and Sealed this

Fourteenth Day of October, 2003

JAMES E. ROGAN
*Director of the United States Patent and Trademark Office*